US005525299A

United States Patent [19]

Lowe

[11] Patent Number: 5,525,299

[45] Date of Patent: Jun. 11, 1996

[54] CONTAINER CLOSURE

[76] Inventor: Henry E. Lowe, Williams St., Rte. 7, P.O. Box 161, Arcadia, Fla. 33821

[21] Appl. No.: 106,906

[22] Filed: Aug. 13, 1993

[51] Int. Cl.[6] ..... B01L 3/00; B65D 51/20

[52] U.S. Cl. ..... 422/99; 206/219; 215/228; 220/212; 422/102; 588/261

[58] Field of Search ..... 422/102, 61, 99, 422/58, 20, 32; 435/296; 206/221, 219; 215/118; 220/212, 521, 522, 254; 588/261

[56] References Cited

U.S. PATENT DOCUMENTS

| | | | |
|---|---|---|---|
| 2,487,236 | 11/1949 | Greenberg | 206/220 |
| 2,604,976 | 7/1952 | Sarg | 220/521 |
| 2,677,459 | 5/1954 | Ritzenberg | 220/521 |
| 2,941,689 | 6/1960 | Black . | |
| 3,451,540 | 6/1969 | Kulischenko | 206/220 |
| 3,715,189 | 2/1973 | Nighohossian et al. | 215/6 |
| 3,768,688 | 10/1973 | Linke . | |
| 3,779,372 | 12/1973 | de Lloret | 220/521 |
| 3,840,136 | 10/1974 | Lanfranconi et al. . | |
| 3,870,147 | 3/1975 | Orth | 206/222 |
| 4,203,517 | 5/1980 | Hildebrandt et al. | 220/521 |
| 4,235,343 | 11/1980 | Thompson . | |
| 4,386,696 | 6/1983 | Gocalves | 206/221 |
| 4,550,825 | 11/1985 | Sutryn et al. | 206/221 |
| 4,709,822 | 12/1987 | Vataru | 219/216 |
| 4,723,672 | 2/1988 | Puma | 215/228 |
| 4,747,501 | 5/1988 | Greaves | 215/228 |
| 4,776,972 | 10/1988 | Barrett . | |
| 4,793,475 | 12/1988 | Itzel | 206/221 |
| 4,865,899 | 9/1989 | Reichert . | |
| 4,903,828 | 2/1990 | Finke et al. | 206/221 |
| 5,000,314 | 3/1991 | Fuller et al. . | |
| 5,114,011 | 5/1992 | Robbins, III . | |

*Primary Examiner*—Jill Warden
*Assistant Examiner*—Jan M. Ludlow
*Attorney, Agent, or Firm*—Laff, Whitesel, Conte & Saret, Ltd.

[57] ABSTRACT

A cap having two chambers provides a means for and method of decomposing or neutralizing a hazardous chemical residue in a container after it has been emptied at the point of consumption. One of the chambers is a screw cap which normally closes and seals the container prior to the consumption of the hazardous chemical. The other chamber contains a measured amount of a second chemical which decomposes or neutralizes the residue of the hazardous chemical. The other chamber may be sealed off by a rupturable membrane, a screw cap, a friction held stopper, or a tear-off top, any of which may be ruptured or removed at the time when the residue is to be decomposed or neutralized. In the preferred embodiment, a screw cap is removed from the second chamber and the cap is inverted and screwed onto the container rupturing the membrane in the process, thereby releasing the second chemical into the container.

1 Claim, 1 Drawing Sheet

CONTAINER CLOSURE

This invention relates to means for and methods of discarding empty containers for hazardous chemical material and more particularly to cleansing containers in a manner which meet standards prescribed by various governmental environmental protection agencies for decomposing or neutralizing the hazardous residue remaining in the container at the point of consumption of the hazardous chemical.

Reference is made to U.S. Pat. Nos. 5,000,314 and 3,840,136. Other U.S. patents of interest are: U.S. Pat. Nos. 5,114,011; 4,865,899; 4,776,972; 4,235,343; 3,768,688; and 2,941,689. Each of these patents shows a container having two compartments for holding compositions which are to be mixed.

In particular, U.S. Pat. No. 5,000,314 describes a unit dose package. The package includes a dose container having a threaded mouth which is designed to be fitted onto the neck of an empty bottle. The fitment is sealed by foil. In use, the foil is removed and the fitment is screwed onto the bottle after a reconstituting liquid is placed therein.

U.S. Pat. No. 3,840,136 describes a container closure with an auxiliary container which has a frangible or rupturable wall. A cutter within the auxiliary container severs the rupturable wall to release the contents of the auxiliary container. However, none of these patents relates to a container for a hazardous chemical having a closure or cap with a storage chamber for introducing pre-measured amounts of a decomposing or neutralizing agent into the container in order to eliminate the hazard of residual contaminants.

Governmental regulations are continually becoming more stringent for safeguarding the public from any and all hazardous materials and for prescribing the disposal thereof. For example, persons using pesticide must not only attend to a proper disposal of leftover pesticide, but must also decontaminate or neutralize the empty containers which contained the pesticide before they are discarded at the point of consumption. This responsibility for the disposal of empty pesticide containers also carries over to containers of many other chemicals. Therefore, any reference herein to a specific chemical, such as a pesticide, is given by way of reference only. All hazardous chemicals are to be included within the scope of the invention.

The neutralization of a container or decomposition in order to remove a residue of the chemical prior to a disposal of a chemical of the container may be accomplished through oxidation, neutralization (adding acid to base or visa versa), or a reduction via a chemical reaction. However, a misuse of the chemicals (e.g., adding too much or not enough chemical for neutralizing) may create additional and possibly serious problems. Thus, there is a need for a premeasured dosage of a neutralizer or decomposing substance at the time of a container decontamination.

In order to provide a specific example of when a neutralization or decontamination of a container is required at a point of consumption, consider a farmer who empties a five-gallon can of Malathion emulsifiable concentrate into his agricultural spray tank. Usually, a residual amount (often about 5 oz.) of the Malathion is left in the five-gallon can which must be neutralized before it is discarded. While it is always possible that the farmer may be an expert chemist, the manufacturer cannot depend upon him to know how to go about performing any aspect of the chemical decontamination. Therefore, the manufacturer must assume that the empty container may be discarded by someone who knows absolutely nothing about the problems of decontamination.

Thus, the manufacturer may instruct the person disposing of the container to remove a membrane inside a container in order to expose a neutralizer, such as a compressed cake of sodium hydroxide. Next, the person adds one quart of water to the five-gallon can containing the Malathion residue. Then, he is instructed to close the container and shake it to put the sodium hydroxide into the water, thus forming a solution which decomposes the Malathion residue.

Accordingly, an object of the invention is to provide new and novel means for and methods of decontaminating containers of hazardous chemical materials before they are discarded. In particular, an object is to decompose or neutralize the chemical residue in a container before discarding the container. Here, an object is to insure compliance with all pertinent governmental rules and regulations for disposal of specific hazardous chemical materials. In this connection, an object is to provide a way for a manufacturer of hazardous chemical material to be sure that consumers having no special training will be able to dispose of the product container according to the prevailing law.

Still another object of the invention is to protect the environment from hazardous chemical waste which may require a unique treatment for decontamination of a container before its disposal.

In keeping with an aspect of the invention, these and other objects are accomplished by providing a container having a cap which encloses a separate compartment or container for a substance which will decompose or neutralize the hazardous chemical material. The compartment in the cap contains an exact amount of a chemical for decomposing or neutralizing the residue of the hazardous chemical which may reasonably be expected to remain within the container. The compartment in the cap is separated from the container by a suitable barrier which prevents the decontaminating chemical from mixing with the hazardous chemical prior to discarding the container.

The barrier may be a puncturable membrane, a screw cap, a tear-off section, a friction held pop out cap or cork, or the like. At the point of consumption and time of disposal, the consumer punctures or removes the barrier and follows a few simple instructions, such as placing water in the container and shaking it. From the viewpoint of the manufacturer, the disposal requires no technical training or special knowledge, and nothing is left to the discretion of the consumer.

Preferred embodiments of the invention are seen in the attached drawings, wherein.

Figure 1:
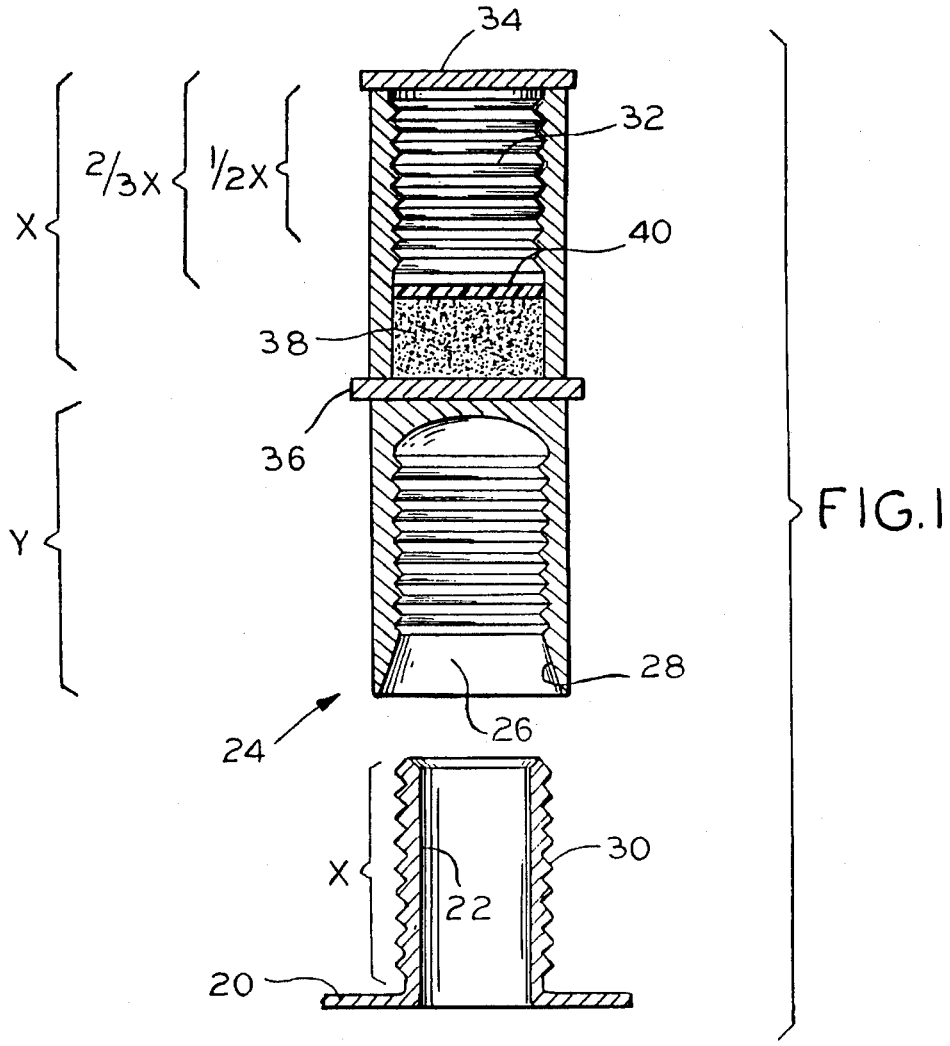
FIG. 1 is a cross section of a reversible cap which has a separate self-puncturing barrier closing a compartment containing a dose of a decomposing or neutralizing chemical.

FIG. 1 shows a bottle or container 20 having a threaded neck 22 with a height "x" which represents any suitable dimension. The cap 24 includes a first internally threaded chamber 26 of any suitable dimension. The chamber 26 terminates in a flare 28 which helps fit it over the neck 22. Hence, the container 20 may be completely closed and sealed by simply fitting chamber 26 over and turning the cap 24 onto the threads 30 on the neck 22. Any suitable washers, gaskets, or other sealing device, may be included within the chamber 26 or sealed over the top of the neck 22 in order to assure a leakproof seal.

The cap 24 has a second threaded chamber 32 which is normally closed by a suitable screw cap 34. A permanent and unbreakable barrier 36 separates the two chambers 26 and 32 so that the contents of container 20 and chamber 32 cannot mix as long as container 20 is closed by the chamber 26. Inside the second chamber 32 is a suitable chemical 38 in a correct amount to decompose or neutralize any residue which might reasonably remain in the container 20 after it has been emptied. The chemical 38 is sealed in its chamber 32 by a protective membrane 40 which prevents it from either being contaminated by ambient moisture or other materials or from prematurely reaching the contents of the container 20.

The neck 22 has a length "x" which is approximately equal to or slightly more than the depth "y" of the first cap chamber 26 so that the container may normally be properly sealed by cap 24. The second and threaded cap 34, which seals the second cap chamber 32, has a length of approximately one-half of "x". When second cap 34 is removed, cap 24 may be inverted and the second threaded chamber 32 may be fitted over and turned onto the threads 30 of neck 22. The rupturable barrier 40 is approximately midway (or about ⅔ "x") between the lengths of second screw cap 34 and neck 30. Hence, the second screw cap 34 cannot reach or damage the barrier 40. However, when second screw cap 34 is removed and threaded chamber 32 of the cap 24 is turned onto neck 22, the length of the neck 22 is such that it will both reach and rupture the barrier 40, thereby releasing chemical 38 into the container 20.

The consumer may have different instructions, depending upon the chemicals involved. In the example given above, the chemical 38 in the chamber 32 is sodium hydroxide which will neutralize Malathion. Therefore, the procedure at the point of consumption is to empty the Malathion from container 20 for whatever purpose the consumer may elect. Then, a quart of water is placed in the empty container which inherently retains some residue of Malathion. Screw cap 34 is removed and the cap 24 is inverted. The screw threads in the second compartment 32 are turned onto the neck 22, puncturing the barrier 40 in the process. Then the container 22 is shaken, mixing the sodium hydroxide 38 with both the water and the residue of Malathion, decomposing it in the process, as follows:

Decomposition of Malathion with Sodium Hydroxide

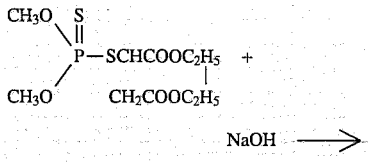

-continued

Decomposition of Malathion with Sodium Hydroxide pH 13
$(CH_3O)_2P(S)SNa$: Quant.

Figure 2:
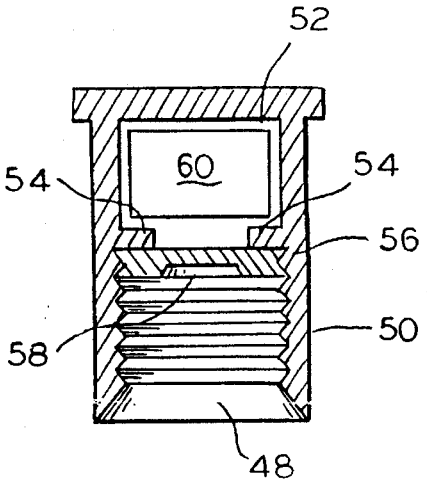
FIG. 2 is a cross-section of a cap having a compartment closed by a screw top.

FIG. 2 shows an alternative cap which may be especially useful when the decomposing or neutralizing chemical is a solid. Here the cap 50 has a first threaded compartment 48 which normally closes the neck of the container 20. In addition, cap 50 has a second compartment 52 containing a solid chemical block 60 held in place by tabs or ledge 54. A screw cap 56 separates the two compartments, normally isolating the neutralizing or decomposing chemical 60 from the contents of the container 20. The screw cap 56 may be removed by a screwdriver that fits into a slot 58. After the screw cap 56 is removed, any chemical 60 in compartment 52 is exposed to the chemical in the container 20.

Figure 3:
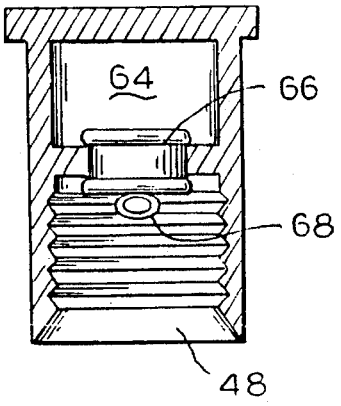
FIG. 3 is a cross section of a cap having a compartment closed by a friction held stopper in the form of a pop out cap or cork.

FIG. 3 shows a cap similar to that shown in FIG. 2. However, here the second compartment 64 is sealed by a stopper in the form of a cork or friction pop-out cap 66 which may be pulled out of the sealing contact by a suitable hook or the like threaded through a loop 68 attached to cap 60.

Of course various other means for rupturing or opening the compartment containing the decomposing or neutralizing chemical may also be used to mix the neutralizing or decomposing chemical with any chemical that may be in the container.

Those who are skilled in the art will readily perceive how to modify the invention. Therefore, the appended claims are to be construed to cover all equivalent structures which fall within the true scope and spirit of the invention.

The invention claimed is:

1. A device for decomposing or neutralizing a residue of a hazardous chemical in a container prior to the disposal thereof, said device comprising a cap having first and second chambers which are physically isolated from each other, each of said first and second chambers having an open end, said second chamber containing a chemical for decomposing or neutralizing residue of a hazardous chemical, and means for releasing said decomposing or neutralizing chemical on demand from said second chamber, wherein said first and second chambers have the same internal diameter and the same internal threading and said means for releasing comprises a rupturable barrier means interposed between the open end of said second chamber and said decomposing or neutralizing chemical.

* * * * *